US008252495B2

(12) United States Patent
Ota

(10) Patent No.: US 8,252,495 B2
(45) Date of Patent: Aug. 28, 2012

(54) ELECTROPHOTOGRAPHIC TONER AND MANUFACTURING METHOD THEREOF

(75) Inventor: Hideki Ota, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 1006 days.

(21) Appl. No.: 11/370,719

(22) Filed: Mar. 7, 2006

(65) Prior Publication Data

US 2006/0204881 A1 Sep. 14, 2006

(30) Foreign Application Priority Data

Mar. 10, 2005 (JP) ..... 2005-067446

(51) Int. Cl.
*G03G 9/093* (2006.01)

(52) U.S. Cl. ..... 430/110.2; 430/110.1; 430/137.11

(58) Field of Classification Search ..... 430/110.2, 430/137.11, 110.1
See application file for complete search history.

(56) References Cited

U.S. PATENT DOCUMENTS 4,740,443 A * 4/1988 Nakahara et al. ..... 430/108.24
5,622,806 A * 4/1997 Veregin et al. ..... 430/137.11
2004/0191666 A1* 9/2004 Kamada et al. ..... 430/125
2005/0064314 A1 3/2005 Fujino et al.
2006/0160007 A1* 7/2006 Kmiecik-Lawrynowicz et al. ..... 430/108.3

FOREIGN PATENT DOCUMENTS

JP 06282107 A 10/1994
JP 2000-147829 5/2000
JP 3141783 12/2000
JP 2005099233 A 4/2005

* cited by examiner

*Primary Examiner* — Mark F Huff
*Assistant Examiner* — Rachel Zhang
(74) *Attorney, Agent, or Firm* — DLA Piper LLP (US)

(57) ABSTRACT

The electrophotographic toner of the present invention comprises toner particles and inorganic fine powder externally added to the toner particles. The toner particles comprise a core particle containing at least a resin, a coloring agent and wax, a first shell layer that is formed on the surface of the core particle to prevent inorganic fine powder from being buried, and a second shell layer that is formed on the surface of the first shell layer to retain inorganic fine powder. This makes it possible to inhibit inorganic fine powder that is an external additive from being buried in a toner and prevent deterioration of developing performance, reduction in transfer efficiency, blocking of a developer and toner aggregation.

9 Claims, 2 Drawing Sheets

ELECTROPHOTOGRAPHIC TONER AND MANUFACTURING METHOD THEREOF

Priority is claimed to Japanese Patent Application No. 2005-067446 filed on Mar. 10, 2005, the disclosure of which is incorporated by reference in its entirety.

BACKGROUND OF THE INVENTION

1. Field of the Invention

The present invention relates to an electrophotographic toner suitable for adding an inorganic external additive, and a manufacturing method thereof.

2. Description of Related Art

Generally, an external additive is added to an electrophotographic toner to provide flowability and the like. Examples of the external additive include such inorganic external additives as silicon dioxide (silica) having a primary particle size of about 5 to 20 nm.

However, when a toner stagnates in a developing machine during a long period of printing, the problem is that an (inorganic) external additive is buried in the toner because of a stress by agitation in the machine. To solve this problem, inorganic fine powder such as silica and titanium oxide having a particle size of 20 to 300 nm or more is combined as a so-called external additive having large particle size.

Meanwhile, Japanese Patent No. 3141783 mentions that wax components existing on the surface of a toner (particularly, pulverized toner) cause toner flowability to be worsened and an external additive to be buried, and proposes a capsule structure toner by particle aggregation method to solve this problem.

Japanese Unexamined Patent Publication No. 2000-147829 proposes a capsule toner wherein a shell is composed of resin having a higher glass transition temperature (Tg) than that of resin constituting a core material.

However, while the use of the above-mentioned external additive having large particle size and the methods described in Japanese Patent No. 3141783 and Japanese Unexamined Patent Publication No. 2000-147829 have some effect of inhibiting an external additive from being buried, the effect is not enough. Therefore, in case of printing for a long period of time or continuous printing at a low coverage rate, it is inevitable that an external additive is buried, causing problems such as deterioration of developing performance (decrease in ID), reduction in transfer efficiency, blocking of a developer and toner aggregation.

SUMMARY OF THE INVENTION

The advantage of the present invention is to provide an electrophotographic toner and a manufacturing method thereof. The electrophotographic toner can inhibit an external additive from being buried in a toner and prevent deterioration of developing performance, reduction in transfer efficiency, blocking of a developer and toner aggregation even in case of printing for a long period of time or continuous printing at a low coverage rate.

After being devoted to research to solve the above problem, the present inventor has found the following fact. That is, the reason why an external additive is buried in a toner is shortage in hardness of resin constituting the toner, compared to inorganic fine powder constituting the external additive. For this reason, even if a capsule shell is composed of resin having a high Tg, to a greater or lesser extent, the external additive is eventually buried.

The present inventor has found that if a burial prevention layer having as much hardness as silica is provided on the surface of a toner, it is possible to fundamentally prevent an external additive from being buried.

In other words, the electrophotographic toner of the present invention comprises toner particles and inorganic fine powder externally added to the toner particles. The toner particles comprise a core particle containing at least a resin, a coloring agent and wax, a first shell layer that is formed on the surface of the core particle to prevent inorganic fine powder from being buried, and a second shell layer that is formed on the surface of the first shell layer to retain inorganic fine powder.

The manufacturing method of the electrophotographic toner of the present invention comprises the steps of forming a first shell layer mainly composed of silicon dioxide on the surface of a core particle containing at least a resin, a coloring agent and wax by using silicon dioxide and a solvent; forming a second shell layer mainly composed of resin on the surface of the first shell layer by adding a solvent containing resin to the core particle on which the first shell layer is formed; fixing the second shell layer on the surface of the first shell layer by heating to a temperature that is not less than a glass transition temperature of resin contained in the second shell layer, thereby obtaining a toner particle; and adding inorganic fine powder whose particle size is larger than a mean layer thickness of the second shell layer to the toner particle.

In the present invention, the first shell layer serves as a layer to prevent inorganic fine powder from being buried. In addition, the second shell layer serves as a layer to retain inorganic fine powder. As a result, even in case of printing for a long period of time or continuous printing at a low coverage rate, it is possible to inhibit inorganic fine powder from being buried in a toner particle on the first shell layer and to fix and retain inorganic fine powder on the surface of a toner particle. It is also possible to prevent deterioration of developing performance, reduction in transfer efficiency, blocking of a developer and toner aggregation.

DETAILED DESCRIPTION OF PREFERRED EMBODIMENTS

〈Electrophotographic Toner〉

In the electrophotographic toner of the present invention, inorganic fine powder is externally added to a toner particle. The toner particle comprises a given core particle, a first shell layer that is formed on the surface of the core particle to prevent inorganic fine powder from being buried, and a second shell layer that is formed on the surface of the first shell layer to retain inorganic fine powder.

Figure 1:
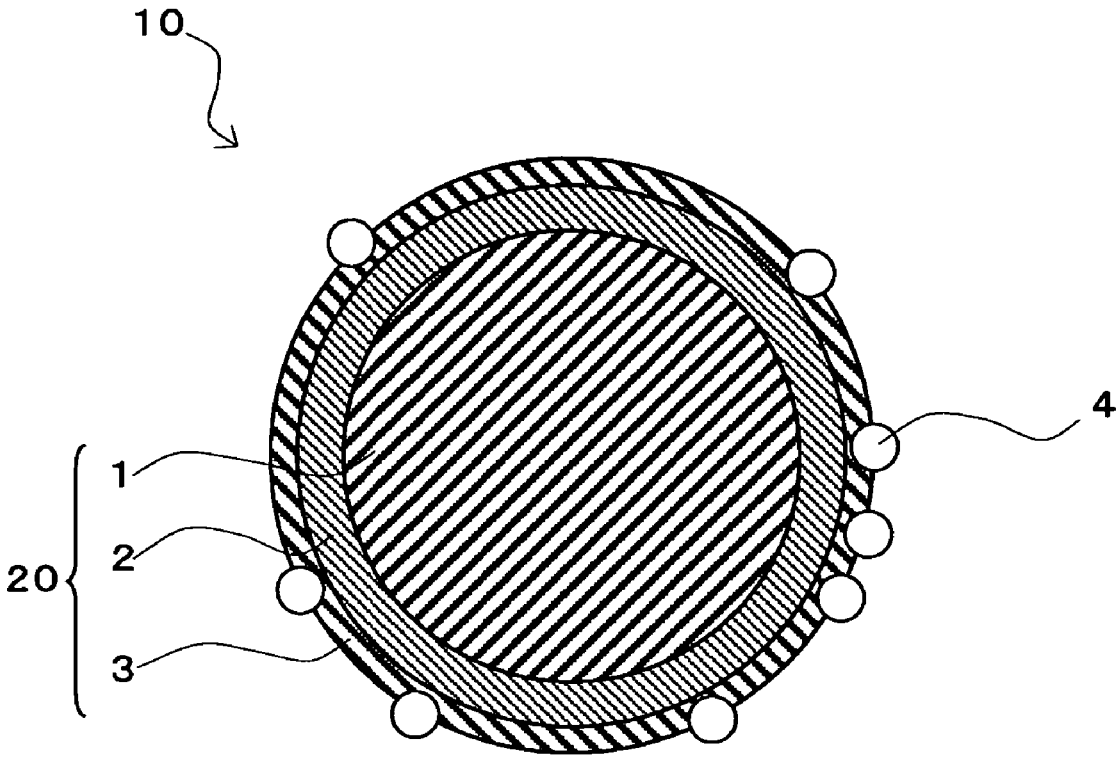
FIG. 1 is a pattern diagram showing the structure of the electrophotographic toner according to one embodiment of the present invention.

One embodiment of the above electrophotographic toner of the present invention will be described, referring to the drawings. FIG. 1 shows the structure of the electrophotographic toner according to one embodiment of the present invention. As shown in FIG. 1, an electrophotographic toner 10 comprises a toner particle 20 and inorganic fine powder 4. The toner particle 20 comprises a core particle 1, a first shell layer 2 formed on the surface of the core particle 1 and a second shell layer 3 formed on the surface of the first shell layer 2. That means the toner particle 20 has a two-layer coated structure of the first shell layer 2 and the second shell layer 3. The added inorganic fine powder 4 is retained by the second shell layer 3.

The core particle 1 contains at least a resin, a coloring agent and wax, and preferably, further contains a charge control agent or a charge control resin. The core particle 1 can be produced through such methods mentioned below as suspension polymerization method, emulsion polymerization and aggregation method, and pulverization method.

As shown in FIG. 1, the first shell layer 2 is formed on the surface of the core particle 1 and covers the core particle 1. The first shell layer 2 plays a role to prevent added inorganic fine powder 4 from being buried. In other words, even if an external force acts on added inorganic fine powder 4, the first shell layer 2 serves as a burial prevention layer to prevent inorganic fine powder 4 from being buried in the first shell layer 2. For this reason, it is preferable that the first shell layer 2 is mainly composed of silicon dioxide. Since this allows the first shell layer 2 to have about as much hardness as inorganic fine powder 4 that is an external additive, the burial of inorganic fine powder 4 can surely be prevented.

The second shell layer 3 is formed on the surface of the first shell layer 2 and covers the first shell layer 2. If an external force acts on added inorganic fine powder 4, some of the inorganic fine powder 4 is buried in the second shell layer 3. That means the second shell layer 3 plays a role to allow inorganic fine powder 4 to be buried and retain it. Therefore, it is preferable that the second shell layer 3 is mainly composed of resin.

The inorganic fine powder 4 is fine particles used as an external additive for the electrophotographic toner 10, and its examples include silicon dioxide (silica), titanium oxide, aluminum oxide and magnetic powder. The magnetic powder is exemplified by ferromagnetic metals such as iron including ferrite and magnetite, cobalt and nickel. In particular, the inorganic fine powder 4 is preferably at least one selected from the group consisting of silicon dioxide, titanium oxide, aluminum oxide and magnetic powder.

Figure 2:
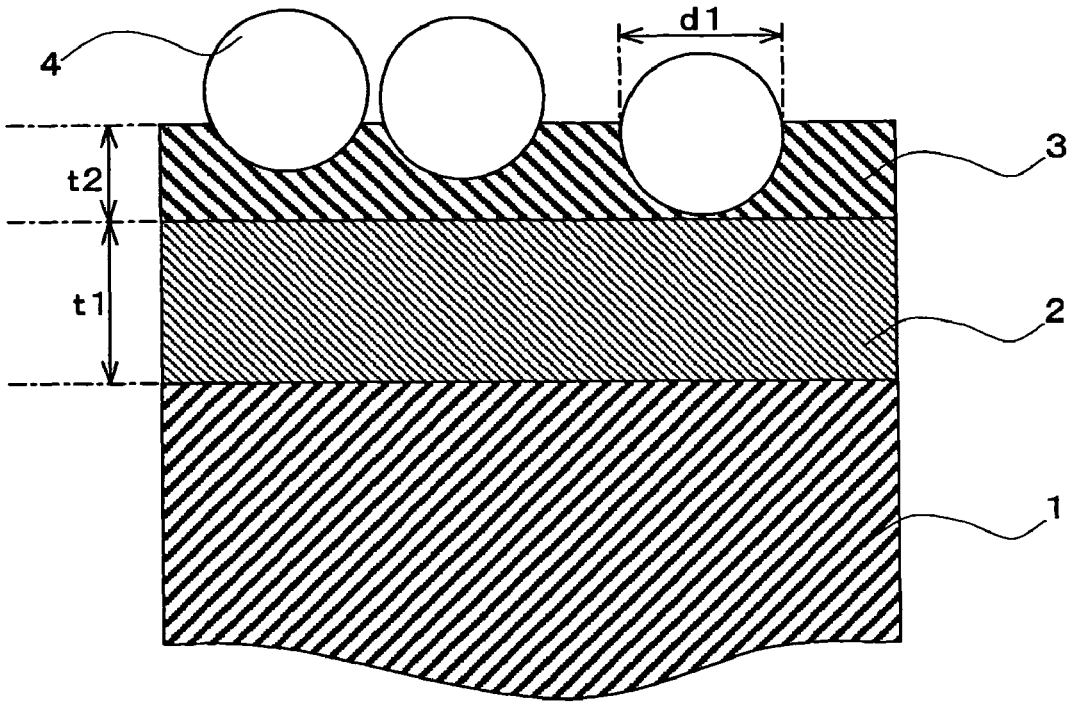
FIG. 2 is a pattern diagram showing the surface of the electrophotographic toner according to one embodiment of the present invention.

FIG. 2 is an enlarged pattern diagram showing the first shell layer 2 and the second shell layer 3. In FIG. 2, t1, t2 and d1 respectively represent the thickness (mean layer thickness) of the first shell layer 2, the thickness (mean layer thickness) of the second shell layer 3 and the particle size (diameter) of the inorganic fine powder 4.

As shown in FIG. 2, in this embodiment, the particle size d1 of the inorganic fine powder 4 to be added is larger than the thickness t2 of the second shell layer 3. This is because if the particle size d1 is the same as or smaller than the thickness t2, the inorganic fine powder 4 may possibly be completely buried in the interior of the second shell layer 3.

The toner 10 may comprise two or more kinds of inorganic fine powder. In this case, preferably, among these kinds of inorganic fine powder to be added, at least one kind of inorganic fine powder has a larger particle size d1 than the thickness t2 of the second shell layer 3. In the present invention, an external additive (inorganic fine powder) having a smaller particle size than t2 and inorganic fine powder 4 having a larger particle size d1 than t2 may be used together. The combination with an external additive (inorganic fine powder) having a smaller particle size than t2 is preferable in that an external additive (inorganic fine powder) which is not buried in the first shell layer 2 improves the flowability of toner. In addition, two or more kinds of inorganic fine powder 4 having a larger particle size d1 than t2 may be used.

The particle size d1 of the inorganic fine powder 4 may be more than 20 nm, preferably, more than 20 nm to not more than 300 nm. It is more preferable to use inorganic fine powder having a particle size of 30 to 200 nm (external additive having large particle size). Specific examples include silica particles having a high effect of improving flowability and having a particle size d1 of not less than 30 nm, silica having a high effect of preventing burial and having a particle size d1 of not less than 40 nm, and titanium oxide. The above-mentioned "particle size" of the inorganic fine powder 4 stands for a mean particle size and can be obtained by performing measurement in a photograph taken with a scanning electron microscope (SEM) at a magnification of 100,000.

The thickness t1 of the first shell layer 2 is not specially limited, but if the first shell layer 2 is too thin, the first shell layer 2 cannot bear the stress of an external additive being buried and therefore has a hole, allowing the external additive to be buried. To prevent such burial, the thickness t1 may be not less than 10 nm, preferably, not less than 20 nm. To make the thickness t1 large, a larger amount of silica to the weight of toner needs to be added. However, addition of too much silica may adversely affect fixing characteristics. Therefore, even when a larger amount of silica is added to make the thickness t1 large, the weight of silica is preferably not more than 10% to the total weight of toner.

The thickness t2 of the second shell layer may be not less than 20 nm, preferably, 20 to 200 nm in order to fix the inorganic fine powder 4 on the surface of toner. This makes it possible to effectively fix and retain an external additive even if an external additive having a particle size of more than 20 nm (external additive having large particle size) is added. In contrast, when the thickness t2 is less than 20 nm, in some cases, the capability to fix and retain the inorganic fine powder 4 having large particle size is lowered, causing the inorganic fine powder 4 to be separated, transfer efficiency to be reduced and the separated inorganic fine powder 4 to contaminate the machine. On the other hand, the upper limit of the thickness t2 of the second shell layer is 200 nm, and more preferably about two thirds of a mean particle size of the applied external additive having large particle size. Larger thickness than this prompts an external additive to be buried and causes the deterioration of flowability, developing performance and transfer efficiency.

The thickness t1 of the first shell layer 2 and the thickness t2 of the second shell layer are obtained by measuring each thickness at three points in the cross-sectional surface of the toner particle 20 with a scanning electron microscope (SEM) and calculating the average value.

〈Manufacturing Method of Electrophotographic Toner〉

Next, a manufacturing method of the above-mentioned electrophotographic toner 10 will be described. The manufacturing method of the electrophotographic toner 10 comprises the steps of forming the first shell layer 2 mainly composed of silicon dioxide on the surface of the core particle 1 by using silicon dioxide and such a solvent as water type medium; forming a layer (the second shell layer 3) mainly composed of resin on the surface of the first shell layer by adding such a solvent as water type medium containing resin to the core particle 1 on which the first shell layer 2 is formed; fixing a resin (the second shell layer 3) by heating to a temperature that is not less than a glass transition temperature of resin contained in the second shell layer 3, thereby obtaining a toner particle; and adding inorganic fine powder having a given particle size to the toner particle.

(1) Core Particle

As mentioned above, the core particle 1 contains at least a resin, a coloring agent and wax, and preferably, further contains a charge control agent or a charge control resin. Resins, coloring agents, wax, charge control agents and charge control resins which can be used to manufacture the core particle 1 are exemplified as follows.

(Resin)

Types of resin which can be used to prepare the core particle 1 are not specially limited and are exemplified by thermoplastic resins such as polystyrene resin, polyacrylic resin, styrene-acrylic copolymer, polyethylene resin, polypropylene resin, vinyl chloride resin, polyester resin, polyamide resin, polyurethane resin, polyvinyl alcohol resin, vinyl ether resin, N-vinyl resin and styrene-butadiene resin.

Polystyrene resin may be a homopolymer of styrene or a copolymer of styrene and other copolymerizable monomers. Examples of the copolymerizable monomers include p-chlorostyrene; vinylnaphthalene; ethylene unsaturated monoolefins such as ethylene, propylene, butylene and isobutylene; vinyl halides such as vinyl chloride, vinyl bromide and vinyl fluoride; vinyl esters such as vinyl acetate, vinyl propionate, vinyl benzoate and vinyl butyrate; (meth)acrylic ester such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; other acrylic acid derivatives such as acrylonitrile, methacrylonitrile and acrylamide; vinyl ethers such as vinyl methyl ether and vinyl isobutyl ether; vinyl ketones such as vinyl methyl ketone, vinyl ethyl ketone and methyl isopropenyl ketone; and N-vinyl compounds such as N-vinyl pyrrole, N-vinyl carbazole, N-vinyl indole and N-vinyl pyrrolidone.

It is possible to copolymerize only one kind or a combination of two or more kinds of these copolymerizable monomers with styrene monomer. Polystyrene resin preferably has two peaks of weight-average molecular weight (low-molecular-weight peak and high-molecular-weight peak). Specifically, it is preferable that the low-molecular-weight peak is within the range of 3000 to 20000 and the high-molecular-weight peak is within the range of 300000 to 1500000. Moreover, as for weight-average molecular weight (Mw) and number-average molecular weight (Mn), Mw/Mn is preferably not less than 10. By keeping the peaks of weight-average molecular weight within this range, it is possible to easily fix toner and improve offset resistance.

Polyester resin is exemplified by resin obtained through condensation polymerization or condensation copolymerization of an alcohol component and a carboxylic component. Examples of the alcohol component include a dihydric alcohol component or a trihydric or polyhydric alcohol component, specifically, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol and polytetramethylene glycol; bisphenols such as bisphenol A, hydrogenated bisphenol A, polyoxyethylene bisphenol A and polyoxypropylene bisphenol A; trihydric or polyhydric alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylol propane and 1,3,5-trihydroxy methylbenzene.

Examples of the carboxylic component include dicarboxylic acids, tricarboxylic acids, and anhydrides or lower alkyl esters of these acids, specifically, dicarboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkyl or alkenyl succinic acids such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid and isododecenyl succinic acid; and tricarboxylic or polycarboxylic acids such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and empol trimer acid.

In terms of good fixability, thermoplastic resin is preferable. However, if the quantity of cross-linking sites (quantity of gel) measured with a Soxhlet extractor is not more than 10% by weight and more preferably in the range of 0.1 to 10% by weight, thermoset resin may be used. As above, adoption of partial cross-linked structure makes it possible to further improve the storage stability, shape maintainability or durability of toner without deteriorating fixability. Therefore, 100% by weight of thermoplastic resin does not need to be used as a resin for toner, and a cross-linking agent may be added or thermoset resin may be partly used. The thermoset resin is exemplified by epoxy resin or cyanate resin, more specifically, one kind or a combination of two or more kinds of bisphenol A type epoxy resin, hydrogenated bisphenol A type epoxy resin, novolac type epoxy resin, polyalkylene ether type epoxy resin, alicyclic epoxy resin and cyanate resin.

The above resin preferably has a glass transition temperature (Tg) of 55 to 70° C. When the resin has a Tg of less than 55° C., toner to be obtained adheres to each other and is apt to have lower storage stability. Meanwhile, when the resin has a Tg of more than 70° C., toner is apt to have poor fixability. Tg of the resin can be figured out from the point of variation in specific heat, using a differential scanning calorimeter (DSC).

(Coloring Agent)

A coloring agent which can be used to prepare the core particle 1 is not specially limited and is exemplified by magenta, cyan, yellow and black coloring agents.

Examples of the magenta coloring agent include C.I. Pigment Red 81, C.I. Pigment Red 122, C.I. Pigment Red 57, C.I. Pigment Red 49, C.I. Solvent Red 49, C.I. Solvent Red 19, C.I. Solvent Red 52, C.I. Basic Red 10 and C.I. Disperse Red 15 that are described in the Color Index.

Examples of the cyan coloring agent include C.I. Pigment Blue 15, C.I. Pigment Blue 15-1, C.I. Pigment Blue 16, C.I. Solvent Blue 55, C.I. Solvent Blue 70, C.I. Direct Blue 86 and C.I. Direct Blue 25 that are described in the Color Index.

Examples of the yellow coloring agent include nitro pigments such as Naphthol Yellow S, azo pigments such as Hansa Yellow 5G, Hansa Yellow 3G, Hansa Yellow G Benzidine Yellow G and Vulcan Fast Yellow 5G or inorganic pigments such as iron oxide yellow and yellow ocher. Examples of the yellow coloring agent also include C.I. Pigment Yellow 12, C.I. Pigment Yellow 180, C.I. Solvent Yellow 2, C.I. Solvent Yellow 6, C.I. Solvent Yellow 14, C.I. Solvent Yellow 15, C.I. Solvent Yellow 16, C.I. Solvent Yellow 19 and C.I. Solvent Yellow 21 that are described in the Color Index.

Examples of the black coloring agent include carbon black such as furnace black, channel black, acetylene black, lamp black and aniline black. In addition, as the black coloring agent, a ferromagnetic metal (magnetic powder) such as iron including ferrite and magnetite, cobalt and nickel may be added.

(Wax)

Examples of wax which can be used to prepare the core particle 1 include vegetable wax such as carnauba wax, sugar wax and tree wax; animal wax such as bees wax, insect wax, whale wax and wool wax; and synthetic hydrocarbon wax such as Fischer-Tropsch wax having ester as side chain, polyethylene wax and polypropylene wax. The wax preferably has an endothermic main peak of 70 to 135° C. in the endothermic curve by a differential scanning calorimeter. This is because the endothermic main peak of lower than 70° C. may cause blocking of toner and hot offset while the endothermic main peak of higher than 135° C. may make it impossible to attain low-temperature fixability. The amount of added wax is preferably in the range of 0.1 to 20 parts by weight to 100 parts by weight of resin. When the amount of added wax is less than 0.1 parts by weight, it is difficult to attain enough effects of the wax. On the other hand, when the amount of added wax is more than 20 parts by weight, blocking resistance may be lowered and separation from toner may occur.

(Charge Control Agent/Charge Control Resin)

A charge control agent is exemplified by positively chargeable charge control agents and specific examples include azine compounds such as pyridazine, pyrimidine, pyrazine, orthooxazine, metaoxazine, paraoxazine, orthothiazine, metathiazine, parathiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline and quinoxaline; direct dyes composed of an azine compound such as azine fast red FC, azine fast red 12BK, azine violet BO, azine brown 3G, azine light brown GR, azine dark green BH/C, azine deep black EW and azine deep black 3RL; nigrosine compounds such as nigrosine, nigrosine salts and nigrosine derivatives; acid dyes composed of a nigrosine compound such as nigrosine BK, nigrosine NB and nigrosine Z; metal salts of naphthenic acid or higher fatty acid; alkoxylated amine; alkylamide; quaternary ammonium salts such as benzylmethyl hexyldecyl ammonium and decyl trimethyl ammonium chloride. Only one kind or a combination of two or more kinds of these can be used.

In addition, resin or oligomer which have quaternary ammonium salt, carboxylate or a carboxyl group as a functional group can be used as positively chargeable charge control agent or charge control resin. Specific examples include one kind, or two or more kinds of styrene resin having quaternary ammonium salt, acrylic resin having quaternary ammonium salt, styrene-acrylic resin having quaternary ammonium salt, polyester resin having quaternary ammonium salt, styrene resin having carboxylate, acrylic resin having carboxylate, styrene-acrylic resin having carboxylate, polyester resin having carboxylate, polystyrene resin having a carboxyl group, acrylic resin having a carboxyl group, styrene-acrylic resin having a carboxyl group and polyester resin having a carboxyl group.

As a negatively chargeable charge control agent, for example, organometallic complex and chelate compound are effective. Examples include aluminum acetylacetonate, iron (II) acetylacetonate and 3,5-di-tert-butylsalicylic acid chrome. Especially, acetylacetone metallic complex, salicylic acid metallic complex or salt are preferable. In particular, salicylic acid metallic complex or salicylic acid metallic salt are preferable.

The method for producing the core particle 1 having the above-mentioned composition is not specially limited. However, in the present invention, it is preferable to adopt a method selected from suspension polymerization method, emulsion polymerization and aggregation method, and pulverization method. This makes it possible to efficiently obtain the core particle 1, thereby improving productivity of the electrophotographic toner 10.

(Suspension Polymerization Method)

Through suspension polymerization method, for example, the core particle 1 can be obtained as follows. A composition containing a polymerizable monomer, a coloring agent, a polymerization initiator, a charge control agent and the like is added in the aqueous phase under agitated condition and granulated. After polymerization reaction, particles are filtrated and dried, thereby obtaining the core particle 1.

Examples of the polymerizable monomer include a monovinyl aromatic monomer, an acrylic monomer, a vinyl ester monomer, a vinyl ether monomer, a diolefin monomer and a monoolefin monomer.

As a coloring agent, a coloring agent similar to the above-mentioned can be used. The amount of added coloring agent may be 2 to 20 parts by weight, preferably, 4 to 15 parts by weight to 100 parts by weight of resin.

Examples of the polymerization initiator include benzoyl peroxide, lauroyl peroxide, isopropyl peroxicarbonate, cumene hydroperoxide, 2,4-dichloryl benzoyl peroxide and methyl ethyl ketone peroxide.

As a charge control agent, a charge control agent similar to the above-mentioned can be used. The amount of added charge control agent may be 1 to 15.0 parts by weight, preferably, 1.5 to 8.0 parts by weight to 100 parts by weight of resin. When the amount of added charge control agent is smaller than the above range, in some cases, it is difficult to charge toner stably. Also, if an image is formed by developing an electrostatic latent image with toner, image density may be lowered. On the other hand, when the amount of added charge control agent is larger than the above range, resistance to environment may be lowered. In particular, poor charging or image defect may occur at high temperature and high humidity, contaminating a photoreceptor.

(Emulsion Polymerization and Aggregation Method)

Through emulsion polymerization and aggregation method, for example, the core particle 1 can be obtained as follows. A coloring agent, a charge control agent and the like are added to a dispersion liquid containing a polymer obtained through emulsion polymerization. Subsequently, through aggregation and ripening, the core particle 1 can be obtained.

Unlike the above-mentioned method, for example, when obtaining a polymer in emulsion polymerization, a coloring agent may be added together with wax. As a coloring agent, a coloring agent similar to the above-mentioned may be used and its amount to be added is preferably 3 to 20 parts by weight to 100 parts by weight of resin. As a charge control agent, a charge control agent similar to the above-mentioned may be used. In particular, however, the use of quaternary ammonium salt compound as a positively chargeable charge control agent and salicylic acid metallic salt as a negatively chargeable charge control agent is preferable. The amount to be used may be determined according to a desirable charge amount for toner, but it may be 0.01 to 15 parts by weight, preferably, 0.1 to 10 parts by weight to 100 parts by weight of resin.

(Pulverization Method)

Through pulverization method, for example, the core particle 1 can be obtained as follows. A given amount of resin, wax, a charge control agent, a coloring agent and the like are added. These are agitated and mixed in a mixing device such as a Henschel mixer. Next, the mixture is melted and kneaded with a biaxial extrusion machine or the like, and after cooling, it is pulverized with a pulverizer such as a hammer mill or a jet mill. Moreover, using a classifier such as an air classifier, the core particle 1 having a given particle size can be produced.

(2) Step of Forming the First Shell Layer

The step of forming the first shell layer is as follows. The core particle 1 and silica particles that are raw material of the first shell layer 2 are dispersed in a solvent (e.g. water type medium). Then, a flocculant (e.g. sodium chloride (NaCl)) is added to attach silica particles to the surface of the core particle 1 and thereby form a shell. Furthermore, it is preferable to fix silica particles to the core particle 1 by heating to not less than a glass transition temperature (Tg) of the core particle 1. Subsequently, through pH control, dispersion system is made alkaline (pH=9 to 13) to fix silica particles to one another. Thereby, the first shell layer 2 is formed. After bringing the dispersion system back to neutrality, the next step is to form the second shell layer.

(3) Step of Forming the Second Shell Layer

In the step of forming the second shell layer, the second shell layer 3 is formed on the first shell layer 2. First, to form the second shell layer 3, using raw resin fine particles and a solvent (e.g. water type medium), a resin fine particle dispersion liquid is prepared. The raw resin is not specially limited and its examples include polystyrene resin, polyacrylic resin, styrene-acrylic copolymer and polyester resin. Examples of the raw resin fine particles include fine particles of about 10 nm to 50 nm synthesized through emulsion polymerization method, and resin obtained by pulverizing resin synthesized through other polymerization methods with a wet-type mill such as an attriter.

After preparing a resin fine particle dispersion liquid, a given amount of the resin fine particle dispersion liquid is added to a dispersion liquid of core particles having the first shell layer formed. Then, a flocculant (e.g. NaCl) is added to attach resin fine particles to the surface of the first shell layer. Thereby, the second shell layer 3 (resin coating layer) can be formed on the surface of the first shell layer 2.

(4) Step of Fixing the Second Shell Layer

Moreover, by heating to not less than a glass transition temperature Tg of resin contained in the second shell layer, the second shell layer 3 can be fixed on the surface of the first shell layer 2. After filtration, cleaning and drying, the toner particle 20 can be obtained.

(5) Step of Adding Inorganic Fine Powder

Subsequently, through dry-type adding process as usual, the electrophotographic toner 10 can be obtained. In this step, inorganic fine powder 4 whose particle size is larger than a mean layer thickness of the second shell layer 3 is added to the toner particle 20. For example, one method of the adding process is to mix the toner particle 20 and an external additive (inorganic fine powder 4) with a Henschel mixer or the like.

Referring to examples and comparative examples, the electrophotographic toner of the present invention will be described in detail below. It is understood, however, that the examples are for the purpose of illustration and the invention is not to be regarded as limited to any of the specific materials or condition therein.

EXAMPLES

Examples 1 to 9 and Comparative Example 1

〈Example 1 for Producing a Core Particle: Suspension Polymerization Method〉

After sufficiently dispersing a mixed solution of 80 parts by weight of styrene, 20 parts by weight of 2-ethylhexyl methacrylate, 5 parts by weight of carbon black, 3 parts by weight of low-molecular-weight polypropylene, 2 parts by weight of charge control agent ("BONTRON P-51" by Orient Chemical Industries, Ltd.) and 1 part by weight of divinylbenzene (cross-linking agent) with a ball mill, 2 parts by weight of 2,2-azobis (2,4-dimethyl valeronitrile) was added as a polymerization initiator. Then, 400 parts by weight of ion-exchanged water was added thereto. Furthermore, as suspension stabilizer, 5 parts by weight of tribasic calcium phosphate and 0.1 parts by weight of sodium dodecylbenzene sulphonate were added. After 20 minute agitation at a revolution speed of 7000 rpm with a TK Homo Mixer (by Tokushu Kika Kogyo), polymerization reaction was carried out at 70° C. and 100 rpm in nitrogen atmosphere for 10 hours. Subsequently, acid cleaning was conducted and the tribasic calcium phosphate was removed, thereby obtaining a dispersion liquid (Dispersion liquid 1) containing a core particle having a volume average particle size of 8 μm. Tg of the core particle so obtained was 62° C.

〈Example 2 for Producing a Core Particle: Emulsion Polymerization and Aggregation Method〉

(1) Emulsion Polymerization of Binder 20 parts by weight of styrene, 3.5 parts by weight of butyl acrylate, 0.2 parts by weight of divinylbenzene, 0.7 parts by weight of potassium persulfate as a water-soluble polymerization initiator and 200 parts by weight of ion-exchanged water were put into a round-bottom flask and underwent emulsion polymerization at 100 rpm and 70° C. for 8 hours with an anchor-type impeller, thereby obtaining a dispersion liquid (Dispersion liquid 2) containing styrene acrylic having a mean particle size of 0.3 μm.

(2) Preparation of Additive Dispersion Liquid 5 parts by weight of Carnauba wax type 1 (by S. Kato & Co.), 2 parts by weight of BONTRON P-51 (by Orient Chemical Industries, Ltd.), 4 parts by weight of C.I. Pigment Red 122 (by Dainippon Ink and Chemicals Incorporated) and 0.1 parts by weight of sodium dodecylbenzene sulphonate were put into 200 parts by weight of ion-exchanged water, and then dispersed and mixed for 3 hours in a ball mill, thereby obtaining a dispersion liquid (Dispersion liquid 3) containing an additive having a mean particle size of 0.3 μm.

(3) Formation of Core Particle

The above Dispersion liquids 2 and 3 were mixed and the aggregate was grown at 100 rpm and 40° C. for one hour with an anchor-type impeller in a round-bottom flask. During the above period of one hour, 50 parts by weight of ion-exchanged water wherein 0.5 parts by weight of NaCl was dissolved as a flocculant was continuously poured at a rate of one part by weight per minute for 50 minutes. After aggregation growth, the temperature was raised to 70° C. and fusing was conducted at 100 rpm for 30 minutes, thereby obtaining a dispersion liquid (Dispersion liquid 4) containing a core particle having a volume average particle size of 8 μm. Tg of the core particle so obtained was 63° C.

〈Example 3 for Producing a Core Particle: Kneading Pulverization Method〉

100 parts by weight of binder resin ("TUFTONE NE-410" by Kao Corporation), 5 parts by weight of carbon black ("MA-100" by Mitsubishi Kasei Corporation), 5 parts by weight of charge control agent ("BONTRON P-51" by Orient Chemical Industries, Ltd.) and 4 parts by weight of Carnauba wax type 1 (by S. Kato & Co.) were put into and mixed in a Henschel mixer, then melted and kneaded with a biaxial extrusion machine, cooled with a drum flaker, and coarsely ground with a hammer mill. Next, through pulverization by a mechanical mill and classification by an air classifier, a core particle having a volume average particle size of 8 μm was prepared. Subsequently, by adding 1.0 part by weight of surfactant (sodium dodecylbenzene sulphonate) and dispersing in 500 parts by weight of ion-exchanged water, a dispersion liquid of core particles (Dispersion liquid 5) was obtained. Tg of the core particle so obtained was 62° C.

〈Emulsion Polymerization of Particles for Forming the Second Shell Layer〉

20 parts by weight of styrene, 2 parts by weight of butyl acrylate, 0.2 parts by weight of divinylbenzene, 0.5 parts by weight of water-soluble polymerization initiator (potassium persulfate), 0.4 parts by weight of surfactant (sodium dodecylbenzene sulphonate) and 200 parts by weight of ion-exchanged water were put into a round-bottom flask and underwent emulsion polymerization at 100 rpm and 70° C. for 8 hours with an anchor-type impeller, thereby obtaining a dispersion liquid of styrene acrylic resin particles (Dispersion liquid 6). The styrene acrylic resin particles so obtained had Tg of 75° C., a softening point of 140° C. and a mean particle size of 0.01 μm.

〈Step of Forming the First Shell Layer〉

According to the added amount shown in Table 1, silicon dioxide powder (silica particles, "RA200HS" by Nippon Aerosil Co., Ltd.) was added to Dispersion liquid 1, Dispersion liquid 4 and Dispersion liquid 5 that contain core particles, and sufficiently dispersed in water system, using 2 parts by weight of surfactant (sodium dodecylbenzene sulphonate) (to the weight of silica particles). Subsequently, adding 0.5 parts by weight of flocculant (NaCl) (to the weight of silica particles), silica particles were fixed at 100 rpm and 70° C. for 30 minutes with an anchor-type impeller in a round-bottom flask. Then, after dropping 10 ml of 2N NaOH aqueous solution and making silica adhere, pH of the water system was brought back to neutrality with 2N hydrochloric acid aqueous solution, thereby preparing a dispersion liquid of particles having the first shell layer formed.

〈Step of Forming the Second Shell Layer〉

According to the added amount shown in Table 1, particles for forming the second shell layer (Dispersion liquid 6) were added to the dispersion liquid which was prepared in the above step of forming the first shell layer. Subsequently, adding 0.5 parts by weight of flocculant (NaCl) (to the weight of particles for forming the second shell layer), particles for forming the second shell layer were formed on the surface of the first shell layer.

〈Step of Fixing the Second Shell Layer〉

The particles for forming the second shell layer were fixed at 100 rpm and 75° C. for 30 minutes with an anchor-type impeller in a round-bottom flask, thereby obtaining a composition. Then, by filtrating, cleaning and drying the composition so obtained, raw powder (toner particles) was obtained.

〈Step of Adding Inorganic Fine Powder (Preparation of Toner)〉

By mixing 100 parts by weight of raw powder, 0.8 parts by weight of silica RA200HS (by Nippon Aerosil Co., Ltd., mean particle size 12 nm) and inorganic fine powder (external additive having large particle size) for two minutes in a Henschel mixer, toner was obtained. The prescription of toner such as the type and added amount of inorganic fine powder (external additive having large particle size) and the type of core particles to be used (Dispersion liquids 1, 4 or 5) is presented in Table 1. In Table 1, "Particle size" of external additive having large particle size represents a mean particle size. Each mean layer thickness of the first shell layer and the second shell layer was obtained by measuring each layer thickness at three points in the cross-sectional surface of a toner particle with a scanning electron microscope (SEM) and calculating the average value.

TABLE 1

| | | First shell layer | | Second shell layer | | External additive having large particle size | | |
|---|---|---|---|---|---|---|---|---|
| | Core particle | Added amount[1)] | Mean layer thickness (nm) | Amount of added resin[2)] | Mean layer thickness (nm) | Particle size (nm) | Type[3)] | Added amount[4)] |
| Example 1 | Dispersion liquid 1 | 2.50% | 30.7 | 0.75% | 20.0 | 40 | NA50H | 0.8 |
| Example 2 | Dispersion liquid 1 | 2.50% | 30.7 | 1.20% | 32.0 | 40 | NA50H | 0.8 |
| Example 3 | Dispersion liquid 1 | 2.50% | 30.7 | 1.40% | 37.3 | 40 | NA50H | 0.8 |
| Example 4 | Dispersion liquid 1 | 2.50% | 30.7 | 1.60% | 42.7 | 50 | OX50 | 0.8 |
| Example 5 | Dispersion liquid 1 | 4.00% | 49.1 | 3.00% | 80.0 | 200 | Titanium oxide | 2.5 |
| Example 6 | Dispersion liquid 4 | 2.50% | 30.7 | 1.20% | 32.0 | 40 | NA50H | 0.8 |
| Example 7 | Dispersion liquid 5 | 2.50% | 30.7 | 1.20% | 32.0 | 40 | NA50H | 0.8 |
| Example 8 | Dispersion liquid 1 | 2.50% | 30.7 | 0.60% | 16.0 | 40 | NA50H | 0.8 |
| Example 9 | Dispersion liquid 1 | 2.50% | 30.7 | 1.60% | 42.7 | 40 | NA50H | 0.8 |
| Comp. Ex. 1 | Dispersion liquid 1 | 0.00% | 0 | 1.00% | 26.7 | 40 | NA50H | 0.8 |

[1)]Amount of added silica (% by weight) to the weight of core particle

[2)]Amount of added resin particles (% by weight) to the weight of core particle

[3)]Type: NA50H (silica particles by Nippon Aerosil Co.. Ltd.)

OX50 (silica particles by Nippon Aerosil Co., Ltd.)

Titanium oxide (MPT240 by Ishihara Sangyo Kaisha, Ltd.)

[4)]Amount of added external additive (parts by weight) to 100 parts by weight of toner 〈Preparation of Developer for Evaluation〉

35 g of each type of toner prepared according to the prescription in Table 1 and 700 g of carrier for FS-8008C by Kyocera Mita Corp. were put into a 500 ml polypropylene container and mixed at 100 rpm for 30 minutes, thereby preparing a developer for evaluation.

〈Evaluation Test〉

Using the above developer and an image forming apparatus (FS-8008C by Kyocera Mita Corp.), evaluation test was conducted on initial performance (the first page) and after printing 5000 sheets of paper continuously at 1% coverage. Image density was obtained by measuring a solid image with a GretagMacbeth densitometer. Transfer efficiency was figured out by measuring the amount of toner developed on the drum for solid printing area and the amount of toner remaining on the drum after transfer and using the following formulas. The results are shown in Table 2.

Weight of Transferred Toner (g)=A−B

A=Weight of toner developed on the drum for solid printing area (g)

B=Weight of toner remaining on the drum after transfer (g)

$$\text{Transfer efficiency}(\%) = \frac{\text{Weight of transferred toner}(g)}{\text{Weight of toner developed on the drum for solid printing area}(g)} \times 100$$

The following is the criterion for evaluation in Table 2.

○: Image density is not less than 1.30 and transfer efficiency is not less than 85%.

ΔImage density is 1.25 to 1.29 or transfer efficiency is 80 to 84%.

X Image density is not more than 1.24 or transfer efficiency is not more than 79%.

TABLE 2

| | Initial performance | | After printing 5000 sheets of paper (at 1% coverage) | | | |
|---|---|---|---|---|---|---|
| | Image density | Transfer efficiency | Image density | Transfer efficiency | Remarks | Evaluation |
| Example 1 | 1.44 | 97.3% | 1.33 | 91.4% | Good | ○ |
| Example 2 | 1.45 | 97.2% | 1.41 | 93.2% | Good | ○ |
| Example 3 | 1.43 | 96.8% | 1.37 | 90.4% | Good | ○ |
| Example 4 | 1.47 | 98.3% | 1.41 | 95.4% | Good | ○ |
| Example 5 | 1.44 | 96.6% | 1.33 | 92.1% | Good | ○ |
| Example 6 | 1.49 | 94.4% | 1.35 | 91.2% | Good | ○ |
| Example 7 | 1.43 | 90.4% | 1.33 | 88.9% | Good | ○ |
| Example 8 | 1.44 | 96.9% | 1.27 | 84.2% | (1) | Δ |
| Example 9 | 1.44 | 97.1% | 1.25 | 84.7% | (2) | Δ |
| Comp. Ex. 1 | 1.45 | 97.2% | 0.35 | 72.1% | (3) | x |

(1) Separated external additive causes silica to slightly contaminate the machine, and ID and transfer efficiency to be lowered, but no problem in practical use.

(2) Part of external additive is buried and image density is lowered, but no problem in practical use.

(3) Because of burial of external additive, image density and transfer efficiency are lowered.

According to Tables 1 and 2, when the first shell layer and the second shell layer were formed and a mean layer thickness of the second shell layer was larger than a particle size of inorganic fine powder (external additive having large particle size), namely, in case of Examples 1 to 9, Evaluation was "○" or "Δ", which was a good result.

In particular, Examples 1 to 7 wherein the second shell layer had a mean layer thickness of not less than 20 nm were all rated as "○" in Evaluation, which was a very good result. This is possibly because the second shell layer had a mean layer thickness of not less than 20 nm, thereby enhancing the capability to fix an external additive having large particle size on the surface of a toner particle.

In contrast, in Comparative Example 1 wherein the first shell layer was not formed, image density and transfer efficiency were lowered because of burial of an external additive having large particle size.

It is further understood by those skilled in the art that the foregoing description is a preferred embodiment of the disclosed electrophotographic toner and that various changes and modifications may be made in the invention without departing from the spirit and scope thereof.

What is claimed is:

1. An electrophotographic toner, comprising toner particles and inorganic fine powder externally added to the toner particles, wherein the toner particles comprise a core particle containing at least a resin, a coloring agent and wax, a first shell layer that is formed on the surface of the core particle to prevent inorganic fine powder from being buried, and a second shell layer that is formed on the surface of the first shell layer to retain inorganic fine powder, wherein the first shell layer is mainly composed of silicon dioxide particles, wherein the second shell layer is mainly composed of resin, wherein the first shell layer is formed by attaching silicon dioxide particles to the surface of the core particle in a dispersion liquid of core particles, then fixing the silicon dioxide particles to the surface of the core particle by heating the dispersion liquid to not less than a glass transition temperature (Tg) of the core particle, and further fixing to one another by adjusting the dispersion liquid to be alkaline.

2. The electrophotographic toner according to claim 1, wherein the core particle further contains a charge control agent or a charge control resin.

3. The electrophotographic toner according to claim 1, wherein the first shell layer has a mean layer thickness of not less than 10 nm.

4. The electrophotographic toner according to claim 1, wherein the second shell layer has a mean layer thickness of not less than 20 nm.

5. The electrophotographic toner according to claim 1, wherein the inorganic fine powder is at least one selected from the group consisting of silicon dioxide, titanium oxide, aluminum oxide and magnetic powder.

6. The electrophotographic toner according to claim 1, wherein the inorganic fine powder has a particle size of more than 20 nm.

7. The electrophotographic toner according to claim 1, wherein two or more kinds of the inorganic fine powder are externally added.

8. The electrophotographic toner according to claim 7, wherein at least one kind of the inorganic fine powder has a larger particle size than a mean layer thickness of the second shell layer.

9. The electrophotographic toner according to claim 1, wherein the particle size of the inorganic fine powder is larger than a mean layer thickness of the second shell layer.

* * * * *